US007530250B2

(12) United States Patent
Hartung et al.

(10) Patent No.: US 7,530,250 B2
(45) Date of Patent: May 12, 2009

(54) METHOD FOR STRAIGHTENING A METAL STRIP AND STRAIGHTENING MACHINE

(75) Inventors: Hans-Georg Hartung, Pulheim (DE); Andreas Gramer, Solingen (DE); Ralf-Hartmut Sohl, Solingen (DE); Peter de Kock, Oberhausen (DE); Bodo Falkenhahn, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 112 days.

(21) Appl. No.: 11/661,648

(22) PCT Filed: Aug. 16, 2005

(86) PCT No.: PCT/EP2005/008899

§ 371 (c)(1),
(2), (4) Date: Feb. 27, 2007

(87) PCT Pub. No.: WO2006/024393

PCT Pub. Date: Mar. 9, 2006

(65) Prior Publication Data

US 2008/0098784 A1 May 1, 2008

(30) Foreign Application Priority Data

Aug. 28, 2004 (DE) ..... 10 2004 041 732

(51) Int. Cl.
*B21D 1/02* (2006.01)

(52) U.S. Cl. ..... 72/160; 72/8.4; 72/8.6; 72/9.2; 72/11.4; 72/164

(58) Field of Classification Search ..... 72/8.3, 72/8.4, 8.6, 9.2, 11.1, 11.5, 11.8, 12.5, 160, 72/164, 165, 205, 365.2, 11.4
See application file for complete search history.

(56) References Cited

U.S. PATENT DOCUMENTS

| | | | | |
|---|---|---|---|---|
| 3,587,263 | A * | 6/1971 | McCarthy | 72/9.3 |
| 5,535,610 | A * | 7/1996 | Noe et al. | 72/8.6 |
| 5,666,836 | A * | 9/1997 | Bonnefont et al. | 72/7.2 |
| 5,687,595 | A * | 11/1997 | Noe et al. | 72/8.3 |
| 6,357,273 | B1 * | 3/2002 | Noe et al. | 72/234 |
| 6,857,301 | B1 * | 2/2005 | Bergman et al. | 72/11.7 |

(Continued)

FOREIGN PATENT DOCUMENTS

DE 21 17 489 10/1971

(Continued)

*Primary Examiner*—Edward Tolan
(74) *Attorney, Agent, or Firm*—Friedrich Kueffner

(57) ABSTRACT

The invention relates to a method for straightening a metal strip (1) which is guided in the direction of transportation (R) through a straightening machine (2) and is straightened. In the straightening device (2), the metal strip (1) is impinged upon by a straightening force (F) which is applied by a plurality of straightening rollers (3) in the direction (N) which is perpendicular to the surface of the metal strip (1). According to the invention, prior to the metal strip (1) entering into the straightening machine (2), the thickness (d) of the metal strip (1) is determined and the position (a) of the straightening rollers (3) in the direction (N) which is perpendicular to the surface of the metal strip (1) is taken into account according to the determined thickness (d).

6 Claims, 4 Drawing Sheets

U.S. PATENT DOCUMENTS

| | | | | |
|---|---|---|---|---|
| 7,185,519 | B2 * | 3/2007 | Clark | 72/9.1 |
| 7,383,711 | B2 * | 6/2008 | McKenna | 72/164 |

FOREIGN PATENT DOCUMENTS

| | | |
|---|---|---|
| DE | 33 08 616 | 9/1984 |
| DE | 34 14 486 | 10/1985 |
| DE | 38 40 016 | 5/1990 |
| DE | 42 16 686 | 11/1993 |
| DE | 102 30 449 | 1/2004 |
| EP | 0 035 009 | 9/1981 |
| EP | 0 182 062 | 5/1996 |
| EP | 0 765 196 | 10/1996 |
| EP | 1 275 446 | 1/2003 |
| JP | 62 214 825 | 9/1987 |
| JP | 11 192 510 | 7/1999 |
| WO | 02/076649 | 10/2002 |

* cited by examiner

METHOD FOR STRAIGHTENING A METAL STRIP AND STRAIGHTENING MACHINE

This application is a 35 USC 371 of PCT/EP05/08899 filed Aug. 16, 2005.

The invention concerns a method for leveling a metal strip, which is conveyed through a leveling machine in a direction of transport and leveled in the process. In the leveling machine, the metal strip is acted upon by a leveling force applied by a number of leveling rolls in the direction normal to the surface of the metal strip. The invention also concerns a leveling machine.

The installations for the production and treatment of steel strip, the strip is usually delivered to the installation in coils for further processing or treatment. It is then received in an entry section and unwound and in this way is threaded into the installation for treatment. The metal strip is conveyed into the installation by the unwinding reels. To do this, the bent leading end of the strip must be leveled to allow the strip to be threaded into the entry section of the installation and, if necessary, to allow trouble-free removal of the pieces of scrap at the leading end of the strip.

The quality of the strip treatment and the quality of the strip as such depend on how successful the method is at bringing the initially coiled strip into a flat state. Leveling machines for accomplishing this are known which bring the initially uneven strip into a flat state by applying force to the strip with a number of leveling rolls.

It is necessary, therefore, to use a suitable leveling procedure to ensure that the greatest possible degree of flatness exists after the leveling process. In a leveling machine designed as a roller leveling machine, usually three to seven rollers or rolls are used. To adjust to the strip thickness, the upper leveling rolls can be adjusted or set in the direction normal to the surface of the metal strip. Electric actuators or mechanical spindle-type lifting systems or sometimes excenters are used for this purpose.

EP 1 275 446 A2 discloses a method for eliminating cross-bow in metal strip in a strip processing line with a strip treatment device through which the metal strip passes. The cross-bow is detected in a section of the strip processing line and eliminated by means of a correcting roller with an adjustable depth of penetration. The cross-bow is eliminated in a section of the strip processing line immediately upstream of the strip treatment device.

DE 102 30 449 A1 discloses a method for determining a position control quantity of a leveling roll for the correction of flatness deviations of a metal strip in a leveling machine. The disclosed method provides that actual coefficients of a shape function suitable for describing the shape of the strip are determined from detected values of the flatness deviations of the strip. Target coefficients are then determined from the actual coefficients. Finally, the target coefficients are converted to position control quantities for the leveling roll.

DE 38 40 016 A1 discloses a method for leveling metal strip, wherein the leveling forces are measured on at least one of the leveling rolls of a roller leveling machine, and the leveling roll positions are adjusted as a function of the measured values. This method provides that each leveling force acting perpendicularly to the axes of rotation of the leveling rolls or of the roller bearings or to the frame of the leveling machine is separately measured and that, as a function of these measured values, the leveling rolls are automatically readjusted in the range of the varying compressive forces that arise.

DE 33 08 616 C2 relates to a method for leveling metal strip, in which the metal strip is conveyed between staggered upper and lower leveling rolls and in the process is repeatedly bent in alternating directions with a decreasing degree of deformation, wherein the leveling rolls can be adjusted relative to one another to obtain a predetermined gradual reduction of the degree of deformation according to the cross section of the metal sheet and its nominal strength. In particular, the method process that the leveling force on the leveling rolls is measured during the leveling process, the respective sheet strength is determined from the leveling force and the sheet cross section, and the adjustment of the leveling rolls is continuously corrected according to the given sheet strength.

Other specific design solutions of leveling machines for metal strip or methods for their operation are disclosed in EP 0 765 196 B1, EP 0 182 062 B1, WO 02/076649 A1, DE34 14 486 C2, DE 42 16 686 A1, EP 0 035 009 B1, and JP 11-192, 510.

A problem that has not previously been considered is that although the material properties of the metal strip to be leveled are taken into account, the leveling results are occasionally unsatisfactory due to variations in the thickness of the strip. Especially in the case of the strip ends, which are not rolled out, leveling is problematic, because the leading end of the strip and the trailing end of the strip show strong variation of the thickness of the strip. In some cases there are wedge-shaped or even stepped thickness variations over the longitudinal axis of the metal strip, so that a reproducible leveling process can be realized only with great difficulty.

Therefore, the objective of the invention is to create a method and a leveling machine of the type specified at the beginning, which make it possible by simple means to overcome the aforementioned disadvantage, i.e., to ensure excellent leveling results even when the thickness of the metal strip varies greatly along its longitudinal axis.

The objective of the invention with respect to a method is achieved by a method which is characterized by the fact that, before the metal strip enters the leveling machine, its thickness is determined, and the leveling rolls are adjusted in the direction normal to the surface of the metal strip as a function of the determined thickness.

So that the thickness measurement can be made in a simple way, it is advantageous that it be made a sufficient distance upstream of the leveling rolls. Therefore, in accordance with a refinement of the invention, the leveling rolls are adjusted in a timed way that takes into account the distance of the thickness measurement upstream of the leveling rolls and the conveyance speed of the metal strip in the direction of transport. In other words, the distance of the measurement upstream of the rolls and the conveyance speed are used to determine a delay time, which is taken into consideration in the automatic control of the adjustment of the rolls.

To ensure very high final quality of the strip with respect to its degree of flatness, another refinement of the invention provides that, at the exit end of the leveling machine, a measurement is made to determine the bowing tendency and the deviation of the leveled metal strip from the ideal line, i.e., the ideal center plane, in the direction normal to the surface of the metal strip, and that the adjustment of the leveling rolls in the direction normal to the surface of the metal strip is carried out as a function of the bowing tendency and of the deviation in such a way that the metal strip is as flat as possible after the leveling operation.

In this connection, it can be provided, in particular, that the bowing tendency and the deviation are determined by a displacement measurement, which is made on the metal strip at the exit end.

Alternatively or additionally, the bowing tendency and the deviation can be determined by a load measurement. In this case, it is advantageous for the load measurement to be made by a leveling roll situated at the exit end. As an alternative to this, the load measurement can be made by one or more dancer rolls that are separate from the leveling rolls.

A further improvement of the method of the invention can be realized by measuring the magnitude of the leveling force applied by the leveling rolls during the leveling process in the leveling machine and adjusting the leveling rolls in the direction normal to the surface of the metal strip additionally as a function of the measured leveling force. This makes it possible to compare the material-dependent set force/actual force.

The proposed leveling machine for leveling the metal strip, which is conveyed through the leveling machine in a direction of transport and in the process is leveled, has a plurality of leveling rolls, which can be acted upon in the direction normal to the surface of the metal strip with a leveling force, wherein, in accordance with the invention, means are provided for measuring the thickness of the metal strip, and these means are situated at the entry of the metal strip into the leveling machine or upstream of the entry into the leveling machine with respect to the direction of transport.

The direction of transport can be reversed if necessary. This can be useful if the leveled strip downstream of the leveling machine does not meet the desired flatness requirements. In this case, the adjustment values between the entry end of the leveling machine and the exit end of the leveling machine are mirrored in such a way that the adjustment values in the reverse transport direction correspond to the adjustment values in the transport direction. In this way, the leading end of the strip can be leveled a second time in the reverse transport direction in such a way that it comes to rest at the entry side of the leveling machine with an optimum leveling result. Optionally, the strip can be leveled a third time in the forward transport direction, or the leading end of the strip can be further conveyed through the opened machine.

It is preferred that position-controlled adjusting elements be used, which are suitable for adjusting the leveling rolls in the direction normal to the surface of the metal strip. In this connection, it is especially advantageous for the position-controlled adjusting elements to be designed as hydraulic piston-cylinder systems.

Finally, means can be provided for measuring the bowing tendency and the deviation of the leveled metal strip from the ideal line in the direction normal to the surface of the metal strip, which means are situated at the exit of the metal strip from the leveling machine or downstream of the exit from the leveling machine with respect to the direction of transport. These means can consist of one or two (upper, lower) dancer rolls that are separate from the leveling rolls.

The invention makes it possible to achieve very good leveling results even with strongly varying thickness of the metal strip to be leveled. This has the overall result of improving the quality of the metal strip produced and of making the process of producing the strip simpler and more reliable.

The drawings illustrate a specific embodiment of the invention.

FIGS. 1*a* and 1*b* show schematic side views of an end section of a metal strip.

Figure 1A:
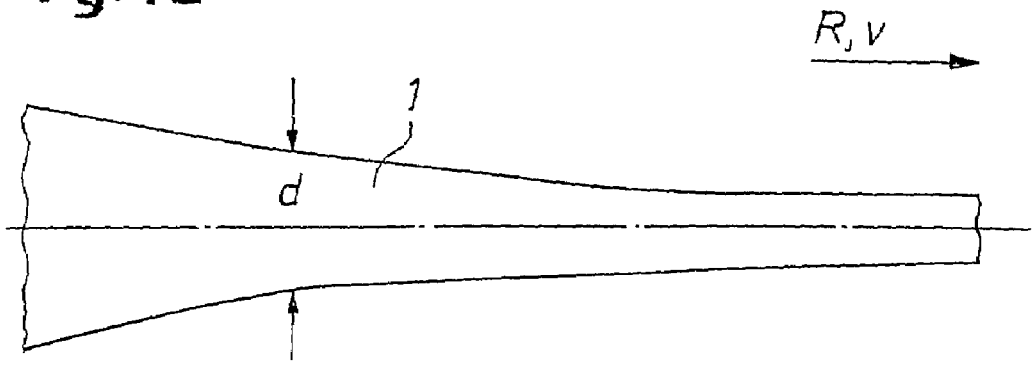
Figure 1B:
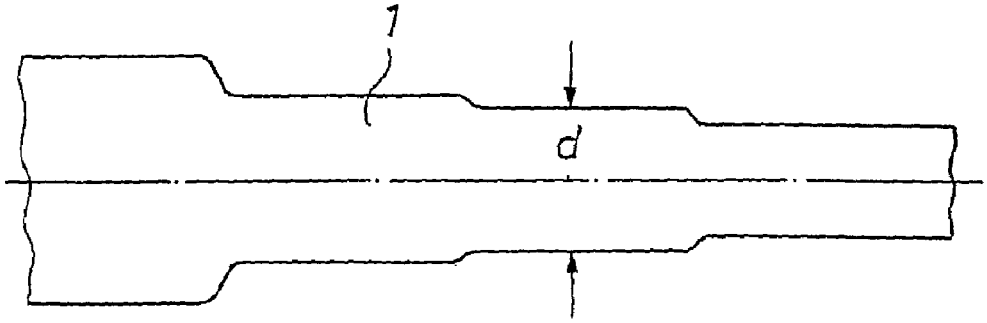

FIGS. 1*a* and 1*b* show side views of a metal strip 1 that is to be subjected to a leveling process. The drawings show the leading end region of a strip that has not been rolled out. Typically, the thickness d of the metal strip 1 is not constant over the longitudinal axis of the strip, which corresponds to the strip transport direction R. FIG. 1*a* shows the case of wedge-shaped thickness variation of the metal strap 1, while FIG. 1*b* shows the case of stepped thickness variation of the strip 1.

Figure 2:
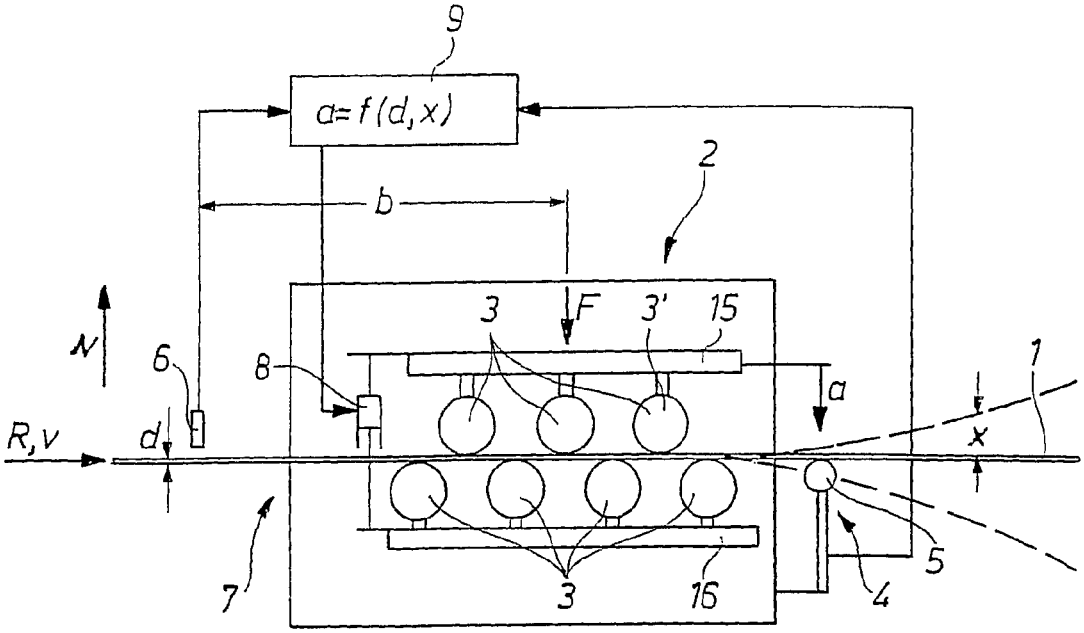
FIG. 2 shows a schematic drawing of a leveling machine for leveling a metal strip.

Leveling a metal strip of this type is extremely difficult and can be efficiently accomplished only with the leveling machine 2 of the type shown in FIG. 2.

The metal strip 1 is conveyed into the leveling machine 2 in transport direction R at a constant speed v. The leveling machine 2 is designed as a roller leveling machine and has a number of leveling rolls 3. The three upper and four lower leveling rolls 3 are installed on supports 15 and 16, respectively. The two supports can be moved relative to each other in the direction N normal to the surface of the metal strip 1. The lower support 16 is mounted in a stationary way, while the upper support 15 can be moved in direction N by means of a position-controlled adjusting element 8 in the form of a hydraulic piston-cylinder system. The adjusting motion of the leveling rolls 3 is designated a. When the leveling rolls 3 are adjusted, the force designated F acts between the rolls and produces deformation of the metal strip 1, so that the metal strip 1 has a high degree of flatness after it exits the leveling machine 2.

In this connection, the goal is for the metal strip 1 to assume the shape represented by the solid lines downstream of the exit 4 of the leveling machine 2 (ideal line). However, in general, without extensive measures, it is to be expected that the metal strip 1 will have a bowing tendency, which manifests itself in either an upward or downward deviation x from the ideal line, as indicated by the broken lines.

To prevent this, the following procedure is followed: A device 6 for measuring the thickness d of the metal strip in the form of a suitable sensor which in itself is already well known is installed upstream of the entry 7 of the leveling machine 2 with respect to the direction of transport R. The distance—measured in the transport direction R—between the sensor 6 and the middle of the leveling rolls 3 is denoted b.

The sensor 6 measures the thickness d of the metal strip 1 and relays the measured value to an automatic control unit 9. The adjustment a of the upper leveling rolls 3 relative to the lover leveling rolls 3 by the adjusting element 8 is carried out as a function of the measured thickness d. In this connection, it is also necessary to take into account the delay time that elapses until the metal strip 1 has moved from the location of the measurement to the location of the leveling rolls 3. The delay time can be easily determined from the distance b and the conveyance speed v.

To find the correct amount for the adjustment a, a suitable algorithm is stored in the automatic control unit 9, or the correct and suitable value of the yield point and thus of the adjustment a is determined on the basis of stored curves, and this adjustment value a is then set by the adjusting element 8.

A dancer roll 5, which detects the deviation x of the metal strip 1 from the ideal position, is mounted at the exit 4 of the leveling machine. The measured deviation value is likewise relayed to the automatic control unit 9, which corrects the adjustment a on the basis of its internally stored algorithms or curves. Instead of a separate dancer roll 5, this measurement can also be carried out with the last leveling roll 3' in the transport direction R.

Figure 3:
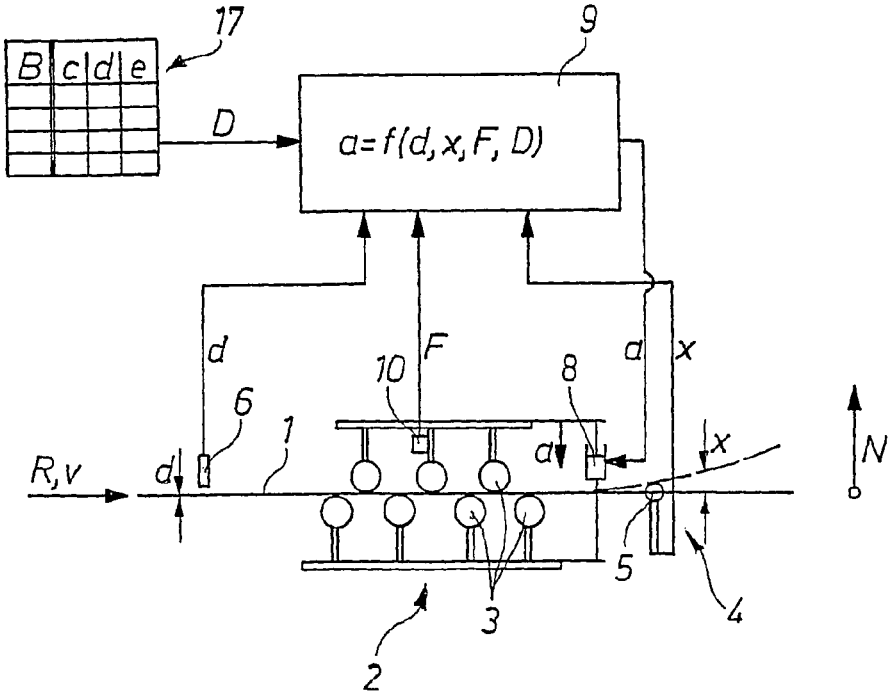
FIG. 3 shows a view similar to FIG. 2, showing the most important controlled variables.

FIG. 3 shows the general control concept for the automatically controlled adjustment a of the leveling rolls 3. The automatic control unit 9 receives the measured thickness d of the metal strip 1 form the sensor 6 as an input parameter. In addition, it is supplied with the leveling force F, which is determined by a load cell or pressure transducer 10. The deviation x of the metal strip 1 from the ideal line in the direction N normal to the surface of the metal strip 1, which is measured at the exit 4 of the leveling machine 2, is supplied as an additional input variable to the automatic control unit 9. This figure also shows that strip data D, which is stored in a database 17, is available to the automatic control unit 9.

The automatic control unit 9 contains a stored algorithm or a table, which uses the thickness d, the deviation x, the leveling force F, and the strip data D to determine the adjustment a necessary to achieve optimum work results. This is represented in FIG. 3 as the functional relationship a=f(d, x, F, D).

Figure 4:
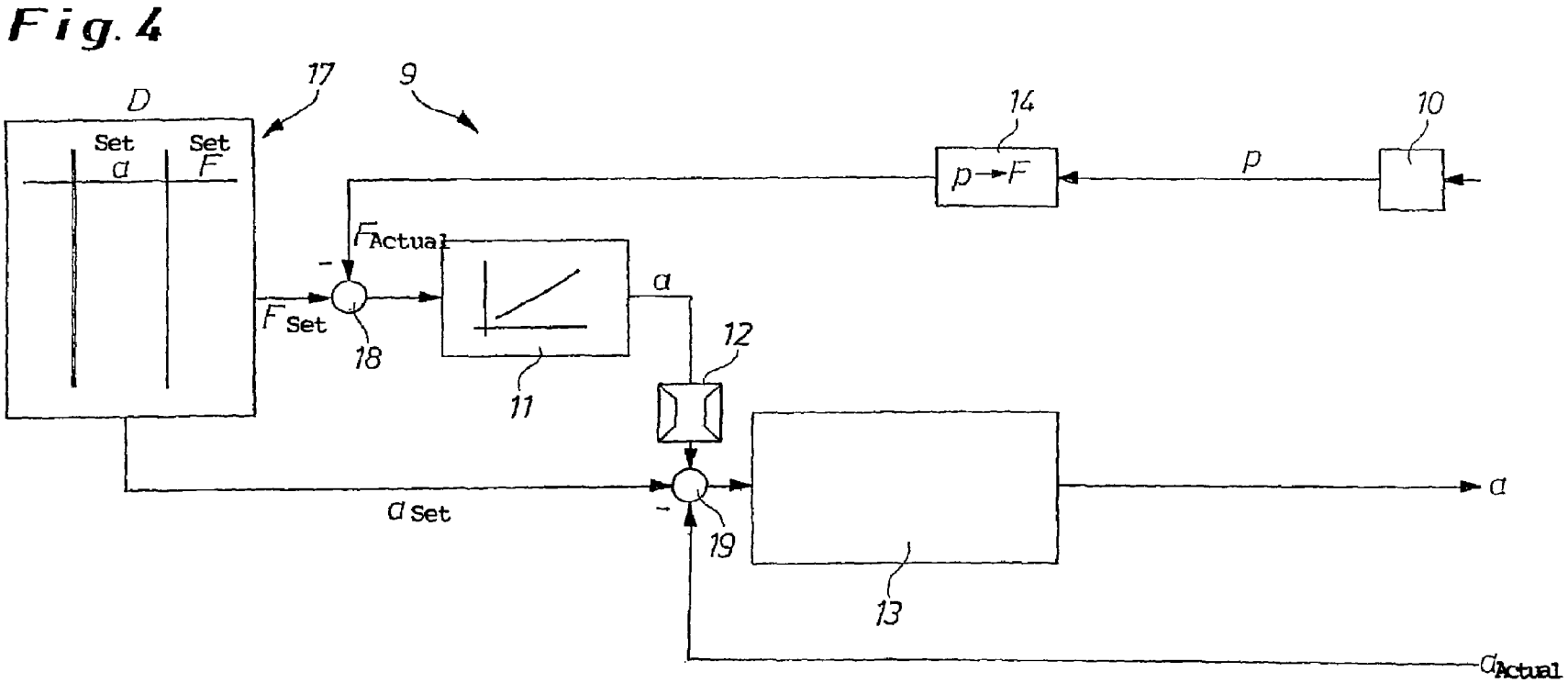
FIG. 4 shows part of the closed-loop control system for carrying out the leveling process.

FIG. 4 shows some of the details of the automatic control engineering: The load cell or pressure transducer 10 detects the pressure p acting in the hydraulic adjusting elements 8. The pressure p can be converted to the leveling force F by a converter 14. The database 17 contains stored strip data D, i.e., for example, information on optimum deformation values for well-defined materials of which the strip 1 is composed. An optimum leveling force set point from the database 17 can be compared with the measured value in the subtractor 18. The differential signal is processed in a slow, e.g., superposed, force controller 11 and then supplied to another subtractor 19 via a limiter 12. The force controller 11 can also be designed to be switched off to realize different operating states, e.g., by means of a switch assigned to the force controller 11. An optimum value for the set adjustment a from the database 17 and the measured value for the adjustment a are also supplied there. The differential signal is supplied to the controller 13, which outputs a correcting value for the adjustment a to the adjusting elements 8.

Figure 5:
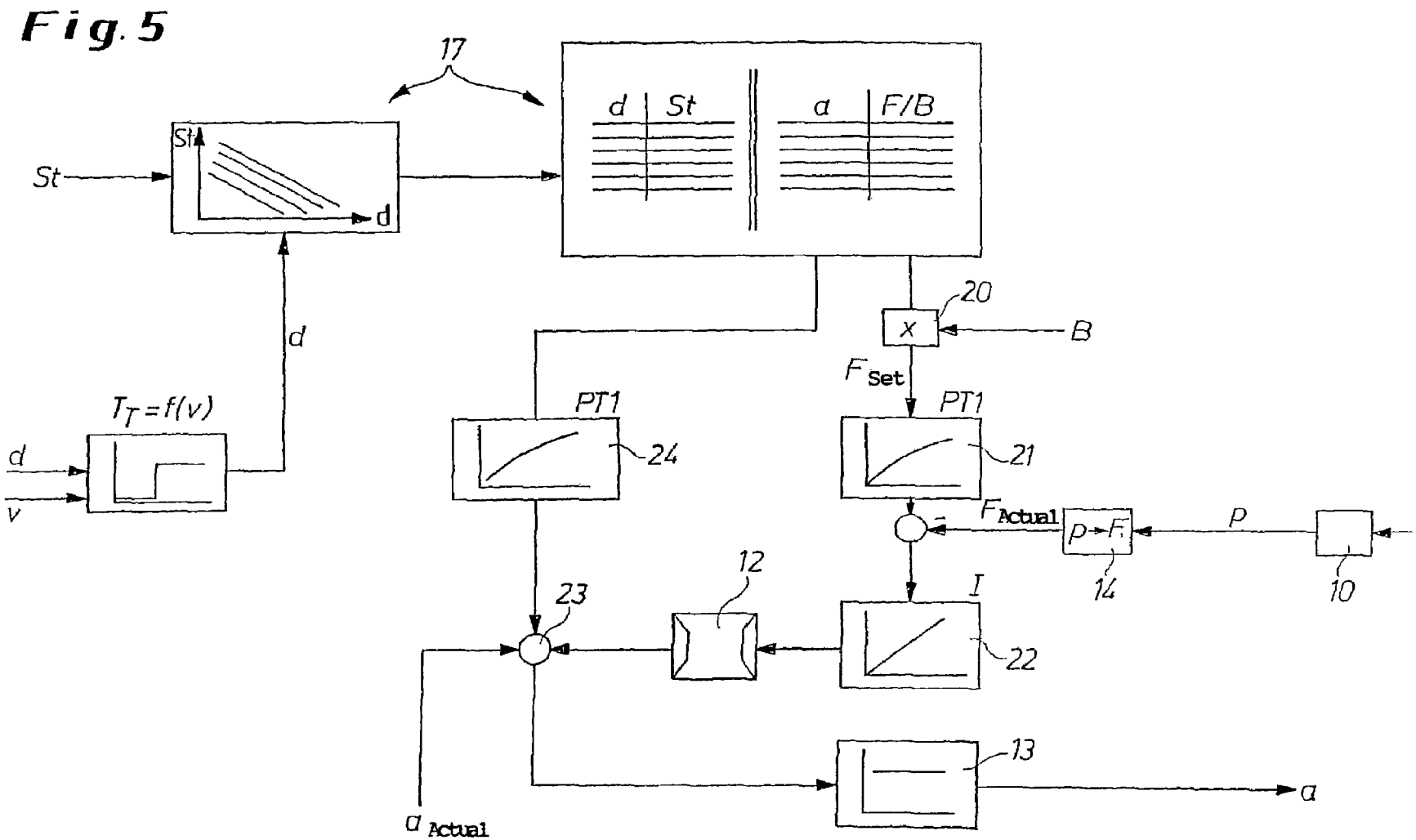
FIG. 5 shows a more detailed representation of the closed-loop control system for carrying out the leveling process.

Further details on the automatic controls setup are shown in FIG. 5. The database 17 contains stored families of curves and tales, which, among other things, specify the yield point St of the material of the metal strip 1 to be processed, which is the optimum yield point for the leveling process. The left region of the database 17 contains families of curves, which define the present yield point St for predetermined strip thicknesses d. In this regard, the hot-strip yield point from starting material for the cold rolling operation and the cold-strip yield point can be take into consideration (possible initial points and end points of the families of curves). The sensor 6 supplies the actual value of the thickness d of the metal strip 1. When the conveyance speed v and the distance b (see FIG. 2) are known, it is possible to determine the time required for the metal strip 1 to reach the location of the leveling rolls 3 from the location of the thickness measurement. This is indicated in FIG. 5 by the delay time element $T_T$ as a function of the speed v.

In the region of the database 17 shown on the left in FIG. 5, the optimum yield point St is determined from the actual thickness value and then transmitted to the region of the database 17 shown on the right. Stored data or stored algorithms are used to determine the required adjustment a and leveling force F with respect to the width B of the metal strip 1 (transverse to the transport direction R) as a function of the thickness d.

Multiplication of this value by the actual width B in the multiplier 20 yields the set leveling force $F_{So11}$. This value is supplied to a controller 21, and the actual leveling force $F_{Ist}$ is subtracted in a subtractor located at the output end of the controller 21. The actual leveling force $F_{Ist}$ is determined by the load cell or pressure transducer 10 and the converter 14. The differential value is supplied to the controller 22, whose signal is transmitted to a subcontractor 23 via the limiter 12.

The target value for the adjustment a comes from the database 17 and likewise arrives at the subtractor 23 via a controller 24. The measured value for the actual adjustment a is also received there as an input. The difference of the signal is sent to the (main) controller 13, which outputs the correcting value for the adjustment a and supplies it to the adjusting elements 8.

The case in which there is only one adjusting element 8 is illustrated, although preferably one adjusting element 8 is installed at each end of the supports 15 and 16, in which case there is twice as much circuitry.

In the present embodiment, the strip thickness is thus measured continuously, and the result is supplied to position-controlled hydraulic cylinders via the automatic control system explained above. The actual strip thicknesses are detected by the thickness measurement sensor 6, and the adjustment values necessary for these thicknesses are made available by the position-controlled hydraulic cylinders. The closed-loop control system ensures continuous adjustment of the leveling rolls, which eliminates the strip thickness influence.

To eliminate the effects of the strength of the metal strip 1, a result-oriented automatic control process is used in that the deviation from the ideal position is also detected on the exit side. The measurement of the deviation or of the compressive loading of the load cell or pressure transducer 10 makes it possible to draw a conclusion about how the readjustment must be made in order to adjust to an optimum leveling result again. A largely bow-free exit of the metal strip 1 from the leveling machine 2 is thus achieved. In addition, the contact pressure in the hydraulic cylinders is detected. This pressure makes it possible to draw conclusions about the properties of the material, especially when the strip thickness is known. This data can also be evaluated for automatic position control and integrated in the closed-loop control system.

The adjustment values and their variations are stored in the database 17 and can thus be used as starting values for presetting the leveling machine 2 when a different metal strip 1 is to be leveled or when a new installation is to be put into operation.

Instead of the specified sensors (for the thickness d, the deviation x and the leveling force F), any other desired types of sensors can be used, e.g., optical sensors.

LIST OF REFERENCE NUMBERS AND LETTERS

1 metal strip
2 leveling machine
3 leveling roll
3' leveling roll
4 exit end
5 dancer roll
6 means for measuring the thickness
7 entry end
8 position-controlled adjusting element
9 automatic control unit
10 load cell/pressure transducer
11 slow force controller
12 limiter
13 controller (P controller)
14 converter
15 support
16 support
17 database
18 subtractor
19 subtractor
20 multiplier

21 controller
22 controller
23 subtractor
24 controller
R transport direction
N direction normal to the surface of the metal strip
F leveling force
d thickness of the metal strip
a adjustment of the leveling rolls
b upstream distance of the thickness measurement from the leveling rolls
v conveyance speed
x deviation of the leveled metal strip
D strip data (database)
p pressure
St yield point
B width of the metal strip

The invention claimed is:

1. A method for leveling a metal strip (1), which is conveyed through a leveling machine (2) in a direction of transport (R) and leveled in the process, where the metal strip (1) is acted upon in the leveling machine (2) by a leveling force (F) applied by a number of leveling rolls (3) in the direction (N) normal to the surface of the metal strip (1), where, before the metal strip (1) enters the leveling machine (2), its thickness (d) is determined, and the leveling rolls are adjusted (a) in the direction (N) normal to the surface of the metal strip (1) as a function of the determined thickness (d), where at the exit end (4) of the leveling machine (2) a load measurement is made to determine a bowing tendency and a deviation (x) of the leveled metal strip (1) from an ideal line in the direction (N) normal to the surface of the metal strip (1), and where the adjustment (a) of the leveling rolls (3) in the direction (N) normal to the surface of the metal strip (1) is carried out as a function of the bowing tendency and of the deviation (x) in such a way that the metal strip (1) is as flat as possible after the leveling operation, wherein the bowing tendency and the deviation (x) are determined by a load measurement.

2. A method in accordance with claim 1, wherein the leaving rolls (3) are adjusted in a timed way that takes into account the distance (b) of the measurement of the thickness (d) upstream of the leveling rolls (3) and the conveyance speed (v) of the metal strip (1) in the direction of transport (R).

3. A method in accordance with claim 1, wherein the load measurement is made by a leveling roll (3') situated at the exit end.

4. A method in accordance with claim 1, wherein the load measurement is made by at least one dancer roll (5) that is separate from the leveling rolls (3).

5. A method in accordance with claim 1, wherein the magnitude of the leveling force (F) applied by the leveling rolls (3) is measured during the leveling process in the leveling machine (2), and the leveling rolls (3) are adjusted (a) in the direction (N) normal to the surface of the metal strip (1) as a function of the measured leveling force (F).

6. A method in accordance with claim 1, wherein, when the direction of transport is reversed, adjustment set points between the entry end and the exit end of the leveling machine are mirrored in such a way that the adjustment set points are optimally adjusted independently of the present direction of transport.

* * * * *